US006666386B1

(12) United States Patent
Huang

(10) Patent No.: US 6,666,386 B1
(45) Date of Patent: Dec. 23, 2003

(54) ATOMIZING NOZZLE STRUCTURE

(76) Inventor: Yu-Chiung Huang, P.O. Box 590, Taichung City (TW), 406

( * ) Notice: Subject to any disclaimer, the term of this patent is extended or adjusted under 35 U.S.C. 154(b) by 0 days.

(21) Appl. No.: 10/162,604

(22) Filed: Jun. 6, 2002

(51) Int. Cl.[7] ..... B05B 1/34

(52) U.S. Cl. ..... 239/463; 239/600; 239/383; 239/390

(58) Field of Search ..... 239/463, 383, 239/600, 271, 390, 394, 396

(56) References Cited

U.S. PATENT DOCUMENTS 3,693,888 A * 9/1972 Rondas et al. ..... 239/533.13
4,347,979 A * 9/1982 Mathews ..... 239/206
4,583,689 A * 4/1986 Rosenberg ..... 239/381
5,143,293 A * 9/1992 Pairis ..... 239/222.17
5,224,653 A * 7/1993 Nelson et al. ..... 239/222.17
5,340,029 A * 8/1994 Adams ..... 239/119
5,718,381 A * 2/1998 Katzer et al. ..... 239/222.11
5,727,735 A * 3/1998 Baumann et al. ..... 239/112
5,823,435 A * 10/1998 Morgan et al. ..... 239/107
5,921,468 A * 7/1999 Palestrant
6,000,636 A * 12/1999 Huang ..... 239/381
6,488,218 B1 * 12/2002 Townsend et al. ..... 239/205

* cited by examiner

*Primary Examiner*—John Rivell
*Assistant Examiner*—Azadeh Kokabi

(57) ABSTRACT

An atomizing spray nozzle structure comprising a main unit, a rotor and a spray nozzle, wherein the main unit and the spray nozzle are joined by thread tightening. Inside the main unit is an accommodating space. The spray nozzle has a through channel running along the axis thereof. The accommodating space is communicative with the through channel, having a rotor inside the through channel and the accommodating space, characterized in that: an end of the rotor corresponding to the accommodating space is a tapered end, and a neck is protruded from the tapered end, the length of the rotor is longer than the through channel at all circumstances, and the end with protruded neck exposed in the accommodating space of the main unit; thereby the rotor can be easily taken out for cleaning purpose after the main unit and the spray nozzle are disassembled.

1 Claim, 6 Drawing Sheets

ATOMIZING NOZZLE STRUCTURE

BACKGROUND OF THE INVENTION (a) Field of the Invention

The invention relates to a spray nozzle structure, particularly an atomizing nozzle structure that produces atomizing effects.

(b) Description of the Prior Art

An atomizing nozzle is used to spray atomized water from small holes to control the temperature and humidity inside a greenhouse growing flowers and/or vegetables.

As shown in FIG. 1, the conventional atomizing nozzle comprises a main unit 11, a rotor 15 and a sealing cap 19. Wherein, inside the main unit 11 are a through hole 12, an accommodating chamber 10 that are communicative with each other, and a taper opening 13 at the intersection of through hole 12 and chamber 10. At the top of main unit 11 is an embedding groove 14. The embedding groove 14 communicates with the accommodating chamber 10. One end of the rotor 15 is a tapered part 16, while the other end has a matching cut groove 17. Thereby, the rotor 15 is positioned in the accommodating chamber 10, the tapered part 16 is matching the taper opening 13, and the rotor 15 is positioned at a specified distance from a wall face of the accommodating chamber 10 to form a clearance 18. On the top side of the sealing cap 19 is a spray nozzle 191, the sealing cap is installed inside the embedding groove 14 of the main unit 11. The top of the embedding groove 14 is punched and pressed to its center to form a flange 111 resting against the peripheral of the top of the sealing cap 19, keeping the sealing cap 19 and the rotor 15 from escaping.

However, since the clearance 18 of the above atomizing nozzle is small, extraneous matter and dust are often trapped in the clearance 18. So after a period of atomizing operation, water could not be sprayed smoothly, resulting in poor atomizing performance and the formation of a water column. Frequent impact of the water column on the plant will result in plant diseases, as well as poor performance of temperature and humidity control.

Therefore, the best solution to remedy the poor atomizing performance of conventional atomizing nozzle is to remove the extraneous matter and dust in water from the atomizing nozzle. However, it can be understood in the above atomizing nozzle structure that, one end of the main unit 11 with the sealing cap 19 is limited by the flange 111 and could not be disassembled; the other end of the main unit 11 inside with the taper opening 13 where between the through hole 12 and the accommodating chamber 10 retains the rotor 15, thus the rotor 15 could not be removed. So, the conventional atomizing nozzle simply could not be disassembled for cleaning purpose. An attempt to clean the inside by projecting water jets will be time and labor consuming with poor effects. Therefore, for effective removal of accumulated dust from the atomizing nozzle, it becomes quite important that the atomizing nozzle is accessible for cleaning.

A spray nozzle was disclosed in U.S. Pat. No. 6,000,636, comprising a rotor installed inside a main unit, and a cap block sealed on one end of the main unit. Wherein, the main unit has formed a flange to retain the cap block from escaping, which simultaneously limit the rotor from escaping. Though with that structure the flange can be destroyed before the rotor is taken out for cleaning purpose, but then the entire nozzle is also destroyed and can no longer be used again.

Another spray nozzle was disclosed in U.S. Pat. No. 5,921,468, comprising a rotor installed inside a main unit, at an end of the main unit being a flange to limit the rotor from escaping. Though with that structure the flange can be destroyed before the rotor is taken out for cleaning purpose, but then the entire nozzle is also destroyed and can no longer be used again. Another type of spray nozzle was also disclosed in the same article, involving a plunger that is plugged to a lower part of a main unit, thereby preventing a rotor accommodated inside the main unit from escaping. Though with that structure the plunger can be removed to clean the rotor, at that stage requiring the cleaning of the rotor, the extraneous matter and dust in water have already accumulated to a sufficient amount to keep the rotor from being removed.

Yet another type of spray nozzle was disclosed in U.S. Pat. No. 5,927,611, comprising a rotor installed in a main unit. However, at that stage when the rotor requires cleaning, the extraneous matter and dust in water have already accumulated to a sufficient amount to keep the rotor from being removed.

SUMMARY OF THE INVENTION

The primary objective of the invention is to provide an atomizing spray nozzle structure that can be disassembled for more cleaning conveniently.

The following are some preferred embodiments of the invention.

BRIEF DESCRIPTION OF NUMERALS

Figure 1:
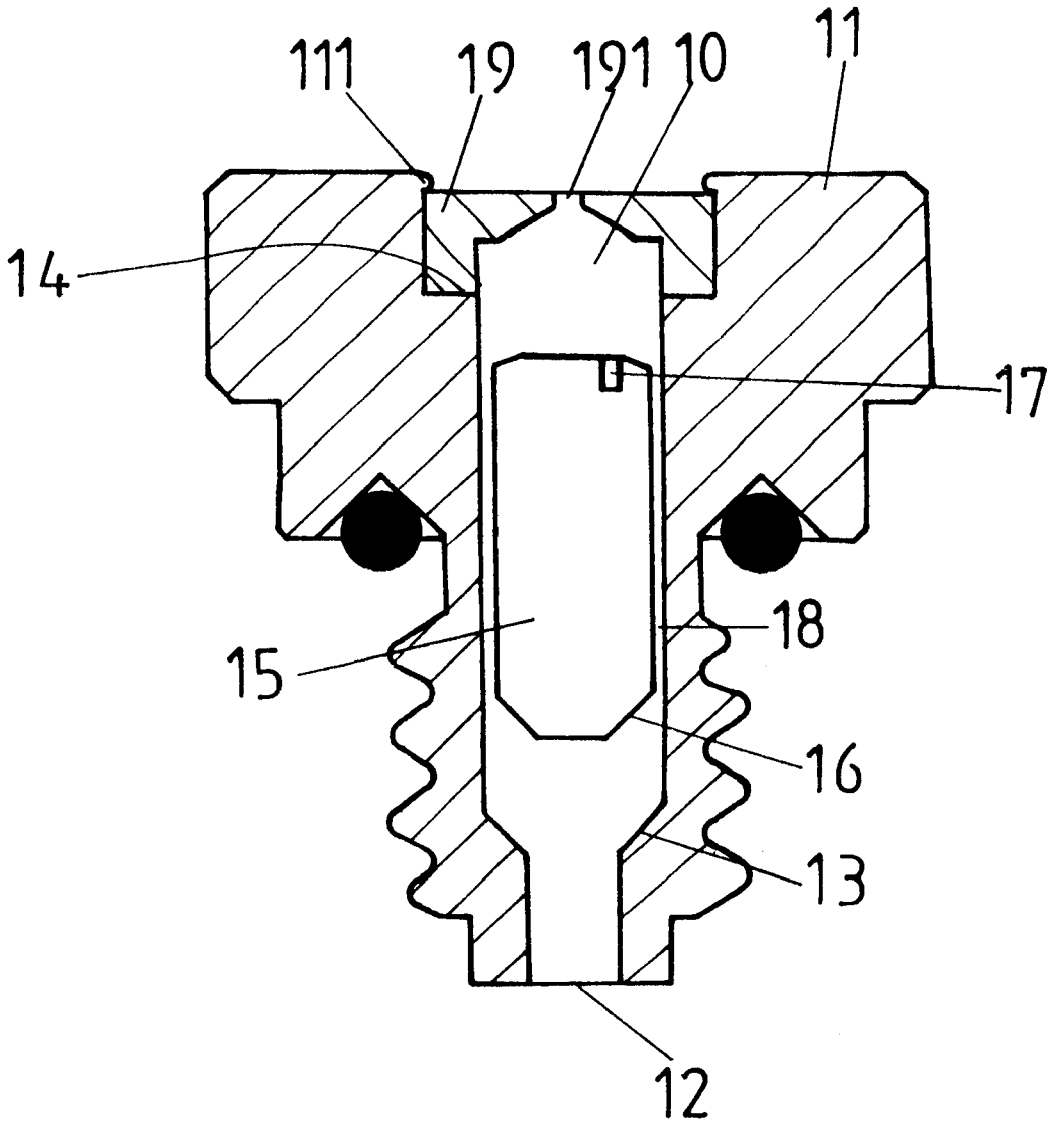
Prior Art FIG—1
FIG. 1 is a prior art of atomizing spray nozzle.

10 accommodating chamber
11 main unit
12 through hole
13 closing opening
14 embedding groove
15 rotor
16 cone part
17 cut groove
18 clearance
19 sealing cap
111 flange
191 sprayhole
21 main unit
22 accommodating space
23 tapering end
24 main unit thread
25 joint
26 joint thread
31 rotor
32 cutgroove
33 tapered end
34 flat end

35 neck
41 spray nozzle.
42 ring face
43 spray joint
44 spray thread
45 through channel
46 accommodating groove
47 sealing cap block
48 spray hole

DETAILED DESCRIPTION OF PREFERRED EMBODIMENTS

Figure 2:
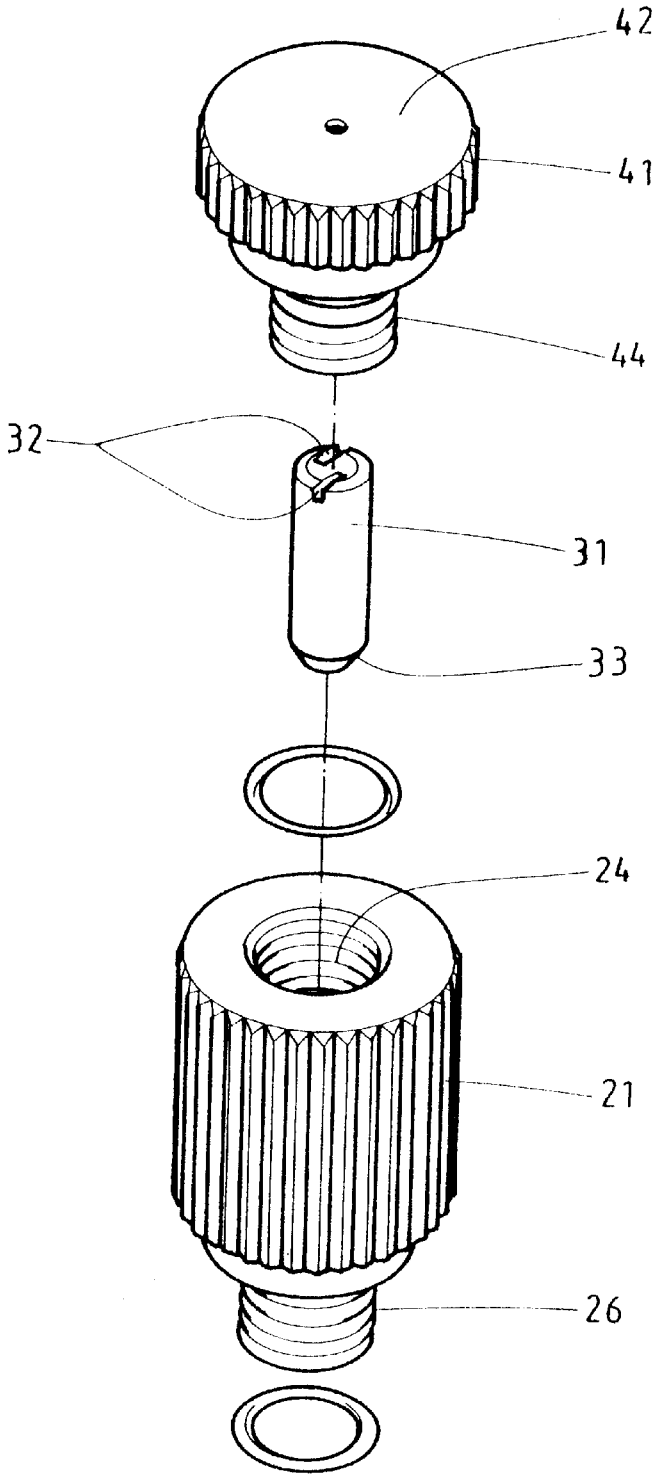
FIG. 2 is an exploded view of a first embodiment of the invention.
Figure 3:
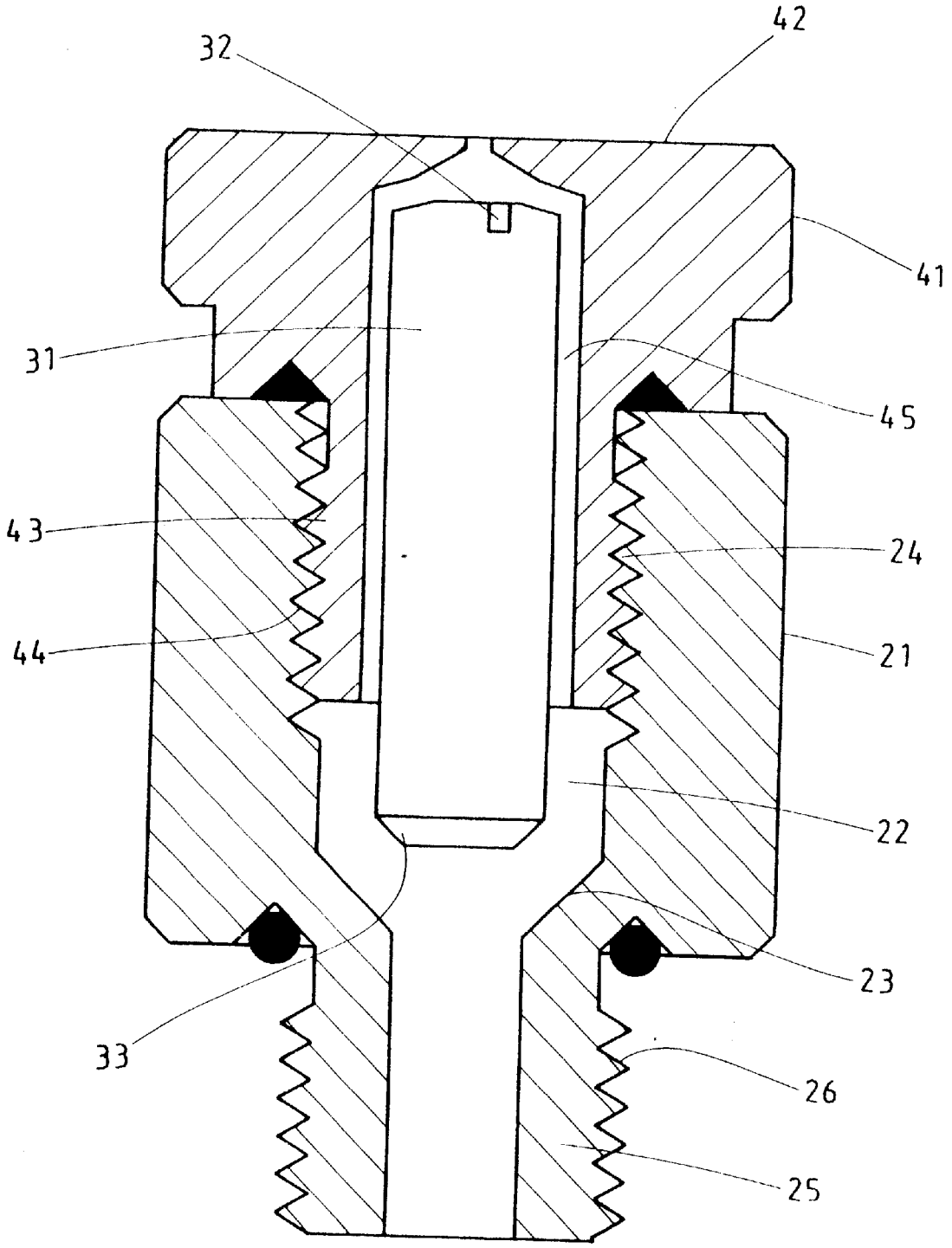
FIG. 3 is a schematic view of the first embodiment of the invention.

As shown in FIGS. 2 and 3, the present invention comprises a main unit 21, a rotor 31 and a spray nozzle 41, wherein, the main unit 21 has an accommodating space 22 at an upper part at an inside axis. One end of the accommodating space 22 has a tapering end 23, the other end has a main unit thread 24 on the inside wall. The main unit 21 has a projected joint 25 on one end thereof. On the surface of the joint 25 is a joint thread 26. The spray nozzle 41 has a ring face 42 and a spray joint 43 at the intersection of ring face 42. On the surface of the spray nozzle joint 43 is a spray nozzle thread 44, with a through channel 45 penetrating the ring face 42 and the spray nozzle joint 43. The spray nozzle 41 has its spray nozzle joint 43 tightened within the accommodating space 22 of the main unit 21. The rotor 31 is installed in-between the through channel 45 of the spray nozzle 41 and the accommodating space 22 of the main unit 21. The rotor 31 has two cut grooves 32 on one end and a tapered end 33 with protruded neck 35 on the other end as shown in the FIG. 5 embodiment. Thereby, the main unit 21, the rotor 31 and the spray nozzle 41 are combined as one unit.

It is important that, length of the rotor 31 is longer than the length of the through channel 45 of the spray nozzle 41 under all circumstances. Thereby, whether the atomizing spray is in use or not, two ends of the rotor 31 are respectively inside the accommodating space 22 and the through channel 45, as well the end with protruded neck 35 of the rotor 31 will be located in the accommodating space 22 of the main unit 21.

Since the spray nozzle 41 and the main unit 21 of the invention are joined to each other by tightening screw, a user can easily separate the main unit 21 and the spray nozzle 41. Since the length of the rotor 31 is longer than the length of the through channel 45 of the spray nozzle 41 under all circumstances, therefore the end with protruded neck 35 of the rotor 31 is exposed outside the through channel 45, in other word, the end with protruded neck 35 exposed in the accommodating space 22 of the main unit 21, when disassemble the main unit 21 and the spray nozzle 41, one end with protruded neck 35 of the rotor 31 being exposed outside the through channel 45, the user can use his fingers to grasp one end of the rotor 31 exposed outside the through channel 45 and take out the rotor 31 that is jammed in the through channel 45 by extraneous matter and dust deposits in water. Thereby the main unit 21, the rotor 31 and the spray nozzle 41 are completely disassembled for the purpose of thorough cleaning.

Figure 4:
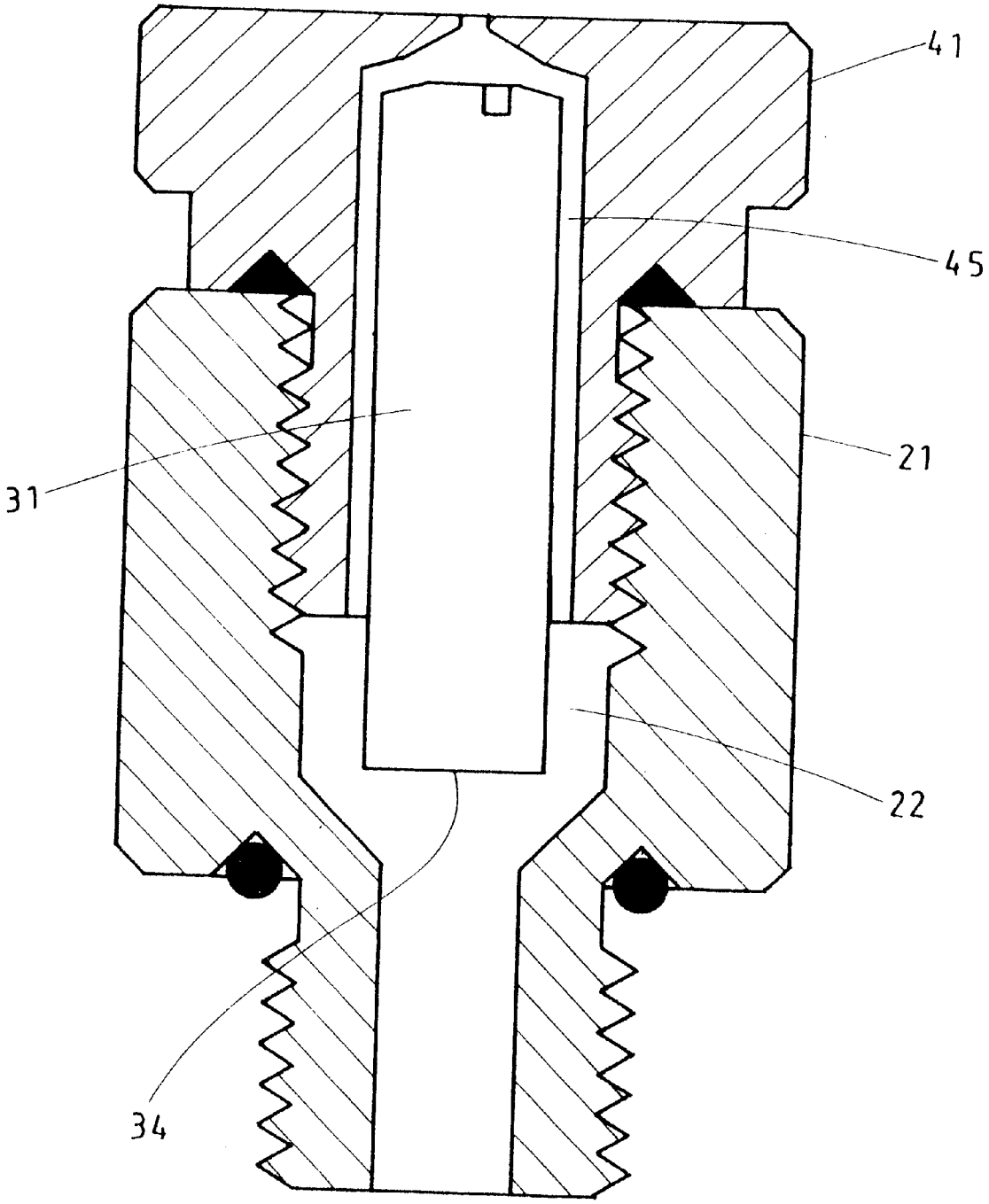
FIG. 4 is a schematic view of a second embodiment of the invention.

As shown in FIG. 4, the difference between the structures of the embodiment shown and FIG. 3 is that one end of the rotor 31 is a flat end 34. When the illustrated rotor 31 is installed in the main unit 21 and the spray nozzle 41, two ends of the rotor 31 are respectively positioned in the accommodating space 22 and the through channel 45.

Figure 5:
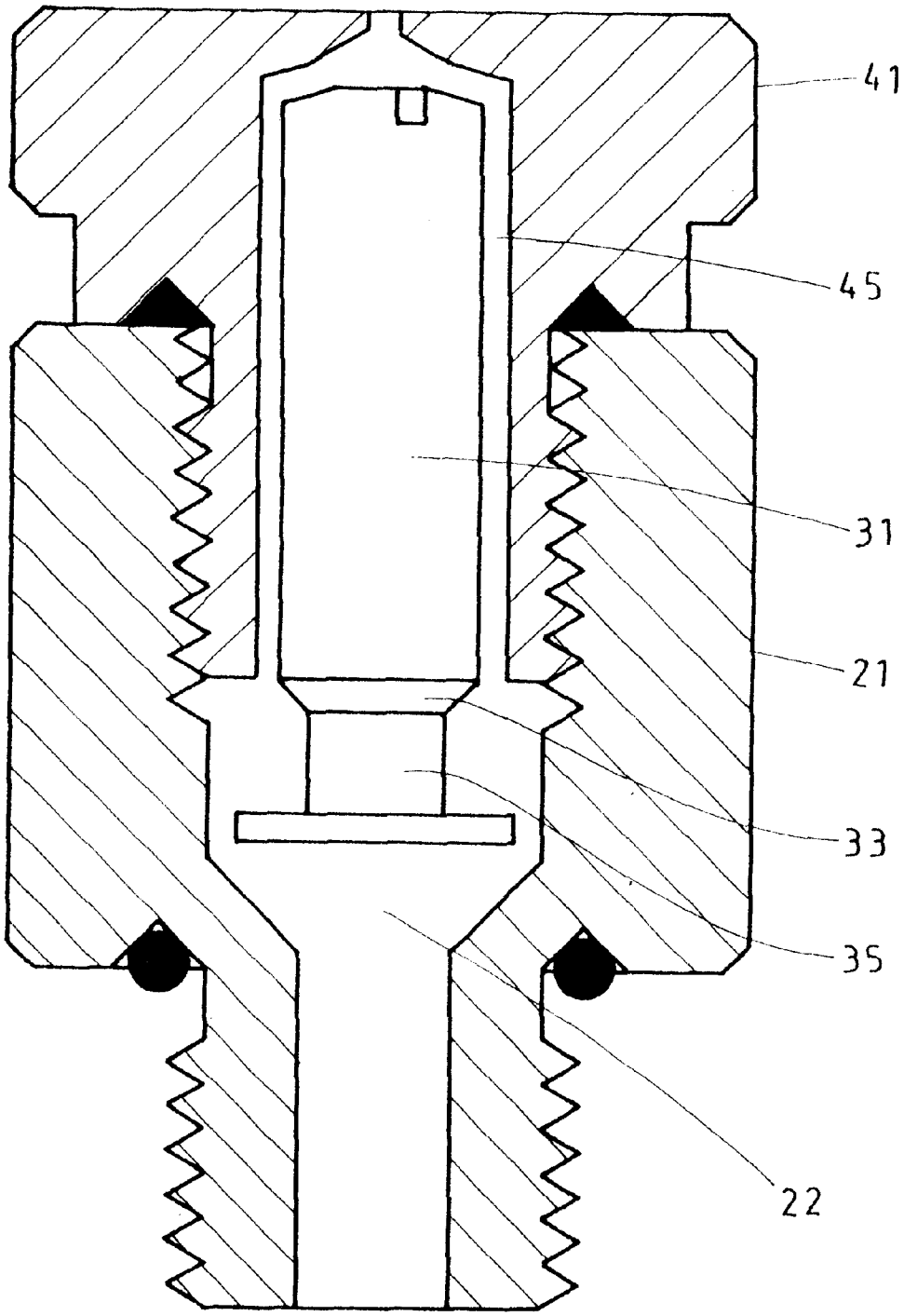
FIG. 5 is a schematic view of a third embodiment of the invention.

As shown in FIG. 5, the difference between the structures of the embodiment shown and FIG. 3 is a neck 35 protruding from the tapered end 33 of the rotor 31. When the illustrated rotor 31 is installed in the main unit 212 and the spray nozzle 41, two ends of the rotor 31 are respectively positioned in the accommodating space 22 and the through channel 45.

Figure 6:
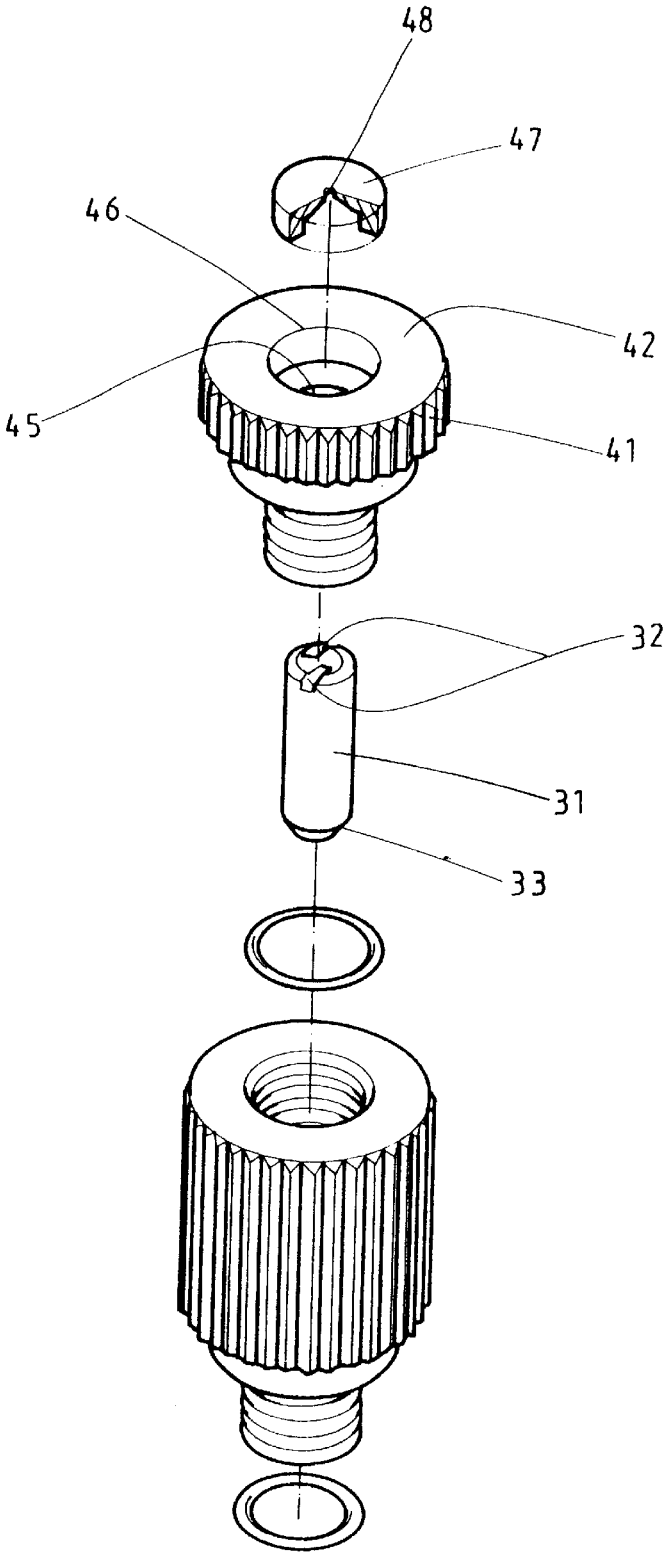
FIG. 6 is an exploded view of a fourth embodiment of the invention.

As shown in FIG. 6, the difference between the structures of the embodiment shown and FIG. 2 is an accommodating groove 46 on the ring face 42 of the spray nozzle 41 corresponding to the through channel 45, and a sealing cap block 47 installed in the accommodating groove 46. At the center of the sealing cap block 47 is a through atomizing hole 48. The illustrated rotor 31 has two cut grooves 32 at one end thereof, while another end is a tapered end 33.

Although the present invention has been illustrated and described with reference to the preferred embodiment thereof, it should be understood that it is in no way limited to the details of such embodiment but is capable of numerous modifications within the scope of the appended claims.

What is claimed is:

1. An atomizing spray nozzle structure which can be disassembled for cleaning, comprising a main unit, a rotor and a spray nozzle, wherein the main unit and the spray nozzle are joined by thread tightening, inside the main unit being an accommodating space, the spray nozzle having a through channel arranged along an axis thereof, the accommodating space being communicative with the through channel, there being a rotor inside the through channel and the accommodating space; characterized in that:

An end of the rotor corresponding to the accommodating space is a tapered end, and a neck is protruded from the tapered end, the length of the rotor is longer than the through channel of the spray nozzle, the end with protruded neck of the rotor exposed in the accommodating space of the main unit; thereby the rotor can be easily taken out for cleaning after the main unit and the spray nozzle are disassembled.

* * * * *